United States Patent [19]

Chen

[11] Patent Number: 5,070,713

[45] Date of Patent: Dec. 10, 1991

[54] PADLOCK

[76] Inventor: Fu L. Chen, No. 1, Lane 28, Li-Hsing Street, Yung-Kang Shiang, Tainan Shien, Taiwan

[21] Appl. No.: 637,540

[22] Filed: Jan. 4, 1991

[51] Int. Cl.[5] ..... E05B 67/22

[52] U.S. Cl. ..... 70/38 B; 70/43; 70/54; 70/455

[58] Field of Search ..... 70/38 R, 38 C, 40–48, 70/54–56, 353, 355, 455

[56] References Cited

U.S. PATENT DOCUMENTS

| | | | |
|---|---|---|---|
| 430,815 | 6/1890 | Thomas | 70/43 |
| 860,333 | 7/1907 | Ryan | 70/43 |
| 1,594,218 | 7/1926 | Soley | 70/43 |

FOREIGN PATENT DOCUMENTS

| | | | |
|---|---|---|---|
| 497745 | 9/1919 | France | 70/43 |
| 110926 | 6/1961 | Pakistan | 70/43 |
| 8032 | of 1889 | United Kingdom | 70/43 |
| 21592 | of 1904 | United Kingdom | 70/43 |
| 421 | of 1905 | United Kingdom | 70/43 |
| 21617 | of 1910 | United Kingdom | 70/42 |

*Primary Examiner*—Rodney M. Lindsey
*Assistant Examiner*—Suzanne L. Dino
*Attorney, Agent, or Firm*—Bacon & Thomas

[57] ABSTRACT

A padlock has a case, a locking mechanism, a shackle and a key. The locking mechanism, which is housed in the case, has a shield chip, five plate tumblers, a locking plate, a plate spring and two plates sandwiching them. To prevent the padlock from being pried open by an illegal tool, a shield chip prevents one of the plate tumblers from being moved up.

7 Claims, 5 Drawing Sheets

PADLOCK

BACKGROUND OF THE INVENTION

Conventional padlocks, as shown in FIGS. 1, 2, 3, generally comprise a key hole block 10, a locking mechanism 1, a bolt 12 and a shackle 13 as the main components. At the top of the key hole block 10 a curved push block 100 is provided, and on the push block is positioned the bolt 12, which elastically contacts the pushing block 100 by means of a spring 120. The bolt 12 has a front end 121 located in a groove 130 formed in the toe of a shackle 13 in the locked position, as shown in FIG. 1.

When the contact surface of pin tumbler pushers 110 in the locking mechanism 11 and pin tumblers 111 become oriented in a straight line with the cylindrical touching surface 14 between the locking mechanism 11 and the key hole block 10, the key hole block 10 can be rotated by a correct key, causing the pushing block 100 to rotate through a certain angle to retract the bolt 12, thereby separating the front end 121 of the bolt 12 from the groove 130 in the shackle 13, in the unlocked position as shown in FIG. 2. The spring 120 moves the bolt 12, and, accordingly, rotates the key hole block 10, causing the front end 121 of the bolt 12, the pin tumbler pushers 110 and the pin tumblers 111 to return to their original positions. In these positions, if the shackle 13 is pressed down, the groove 130 can be engaged by the bolt 12 to lock the shackle 13.

However, the conventional padlocks are considered to have the following shortcomings:

1. A shim can be inserted in the key hole block 10 to illegally unlock it; and, 2. An electric drill can bore a hole through the curved contact surface of the key hole block 10 and the locking mechanism 11 to break the pin tumbler pushers 110 and the pin tumblers 111 to unlock it.

SUMMARY OF THE INVENTION

This invention has been devised to improve the shortcomings of conventional padlocks.

The padlock in accordance with the present invention comprises a case, a locking mechanism, a shackle and a key as the main components.

The case has a front half and a rear half welded together to house the locking mechanism. The front half of the case has a key hole for the key to pass through to reach the locking mechanism. A water-proof lid is positioned on its outer surface with a rivet and spring, usually shielding the key hole and able to be moved aside to expose the key hole. Both half cases have two notches corresponding with each other for the heel and toe of the shackle to pass through.

The locking mechanism has a front plate and a rear plate for sandwiching a moving plate, a spring, a shield chip and five plate tumblers. The rear plate has a guide pin, a spring stop pin, a pivot pin, a position pin and a key hole pin mounted thereon and extending sidewise from its inner surface. The front plate has four small holes to receive the ends of the guide pin, the spring stop pin, the pivot pin, and the position pin as well as a key hole for the key to pass through.

The locking plate has two deep openings at opposite middle sections for the guide pin and the position pin to pass through, a notched, arcuate shaped opening in the lower central section for the key hole pin to pass through, a projecting sidewise arm at a lower left side, and a locking projection at a left upper side which is inserted into a locking hole formed in the toe of the shackle to lock the padlock. The locking plate is positioned to rest on an inner surface of the rear plate.

The spring has its lower end divided into six lengthwise strips to contact the upper edges of the shield chip and five plate tumblers, and is located with its upper end facing the spring stop pin.

The shield chip and five plate tumblers each have a round hole at the right end to enable the position pin to pass through so as to be pivotally retained in their positions so that the pin tumblers can be pivoted about the position pin by the rotation of the key. Thus, stop projections at the left lower sides of the plate tumblers can be separated from the projecting sidewise arm letting the locking plate move to the left to lock the shackle by means of inserting the locking projection into the locking hole of the shackle, or to the right to unlock the shackle by withdrawing the locking projection out of the locking hole.

The shield chip is positioned between the right-most plate tumbler and the second plate tumbler and can prevent the right-most plate tumbler from being moved up if the key projections do not exactly fit in the recesses of the plate tumblers or the notched arcuate shaped opening of the locking plate. In addition, the shield chip can prevent any tool from illegally prying open this padlock, by not permitting the right-most plate tumbler to be moved up and thus keeping its stop projection against the projecting sidewise arm of the locking plate, which as a result, cannot move.

DETAILED DESCRIPTION OF THE PREFERRED EMBODIMENT

Figure 1:
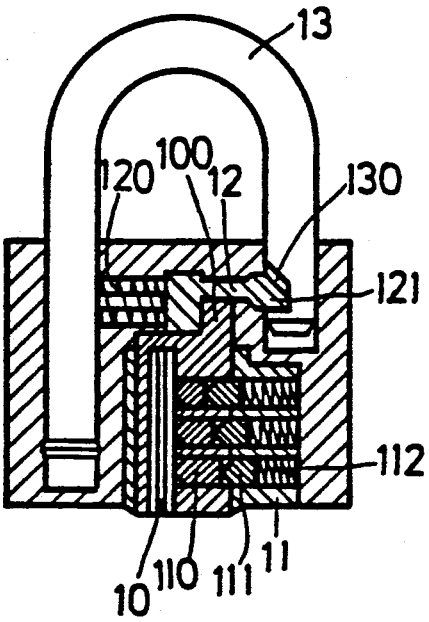
FIG. 1 (PRIOR ART)
FIG. 1 is a front cross-sectional view of a conventional padlock in the locked position.
Figure 2:
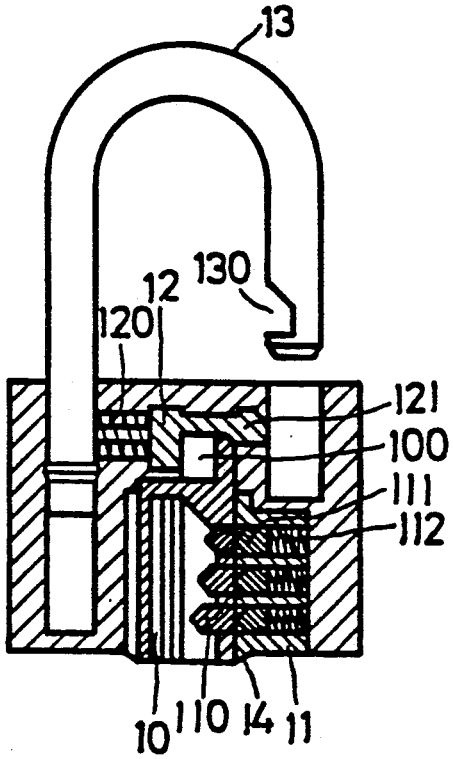
FIG. 2 (PRIOR ART)
FIG. 2 is a front cross-sectional view of a conventional padlock in the unlocked position.
Figure 3:
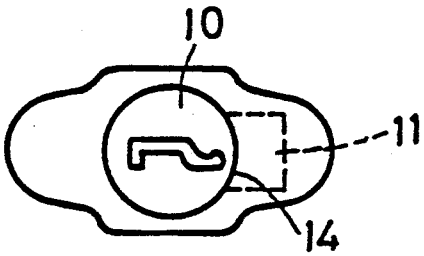
FIG. 3 (PRIOR ART)
FIG. 3 is a bottom view of a conventional padlock.
Figure 4:
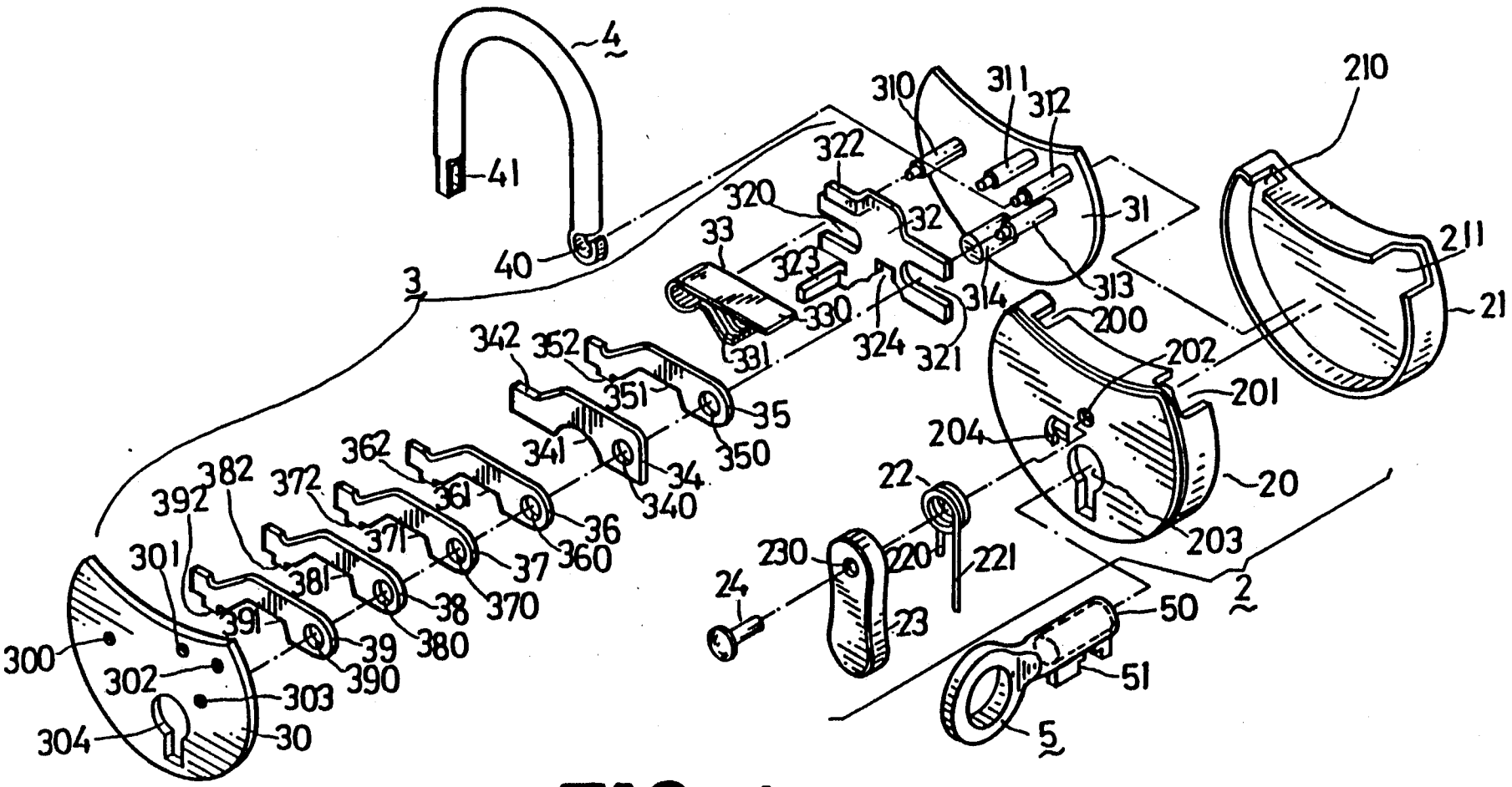
FIG. 4 is an exploded perspective view of the padlock of the present invention.

The padlock in the present invention, as shown in FIG. 4, comprises a case 2, a locking mechanism 3, a shackle 4 and a key 5 as the main components.

The case 2 consists of a front half case 20 and a rear half case 21 welded together. Both half cases 20, 21 have shackle notches 200, 210 in the left sides for the toe of the shackle to pass through, and other shackle notches 201, 211 in the right sides for the heel of the shackle 4 to pass through to be inserted by a pivot pin in a rear plate. The front half case 20 has a round hole 202 for a rivet 24 to retain in position a water-proof lid 23 and a spring 22 on an outer surface; a key hole 203 below the hole 202 for the key of the padlock to pass through; and a stopper 204 positioned offset between the hole 202 and the key hole 203 to stop one end of the spring 22 which has its other end placed in the lid 23.

The locking mechanism 3 comprises a front plate 30, and a rear plate 31. The rear plate 31 has a guide pin 310, a spring stop pin 311, a pivot pin 312, a position pin 313, and key hole pin 314, all extending sidewise from its inner surface.

A locking plate 32 is provided and is located beside the rear plate 31. The plate 32 has deep openings 320, 321 respectively at the right and the left side to accommodate the guide pin 310 and the position pin 313; a locking projection 322 at the left upper side; a projecting sidewise arm 323 at the lower section; and a notched, arcuate shaped opening 324 at the lower center for the key hole pin 314 to pass through. A bent plate spring 33 is pivotally mounted on the guide pin 310, having its top end 330 vesting on the spring stop pin 311 and the lower end 331 divided into six lengthwise strips. A shield chip 34 and five plate tumblers 35, 36, 37, 38, 39 are positioned between the locking plate 32 and the front plate 30 in the order of 35, 34, 36, 37, 38, 39. The shield chip 34 and the plate tumblers each have a round hole 340, 350, 360, 370, 380, 390 at the right end to accommodate the position pin 313. Recesses 341, 351, 361, 371, 381, 391 of different depths are located at the bottom, and the upper edges each contact one of the six divided strips 331 of the plate spring 33. The shield chip 34 has its left upper end resting on the guide pin 310. The plate tumblers 35, 36, 37, 38, 39 each have stop projections 352, 362, 372, 382, 392 at the lower left sides.

The front plate 30 has four small holes 300, 301, 302, 303 to receive the tips of the guide pin 310, the spring stop pin 311, the pivot pin 312, and the position pin 313 as well as a key hole 304 for the key 5 to pass through.

The shackle 4, having a U-shape has a round hole 40 at its heel to be pivotally retained by inserting the pivot pin 312 through the hole 40, and a locking hole 41 at its toe to receive the locking projection 322 of the locking plate 32 to lock the shackle 4.

The key 5 has a cylindrical hole 50 at the front section to fit over the key hole pin 314 on the rear plate 31, and an uneven projection 51 at the front lower side for fitting with the notched, arcuate shaped opening 324 as well as the recesses 351, 361, 371, 381, 391 of the five plate tumblers 35, 36, 37, 38, 39. Rotation of the key 5 pivotally moves the five plate tumblers and the locking plate 32 to the right or the left to unlock or lock this padlock.

Figure 5:
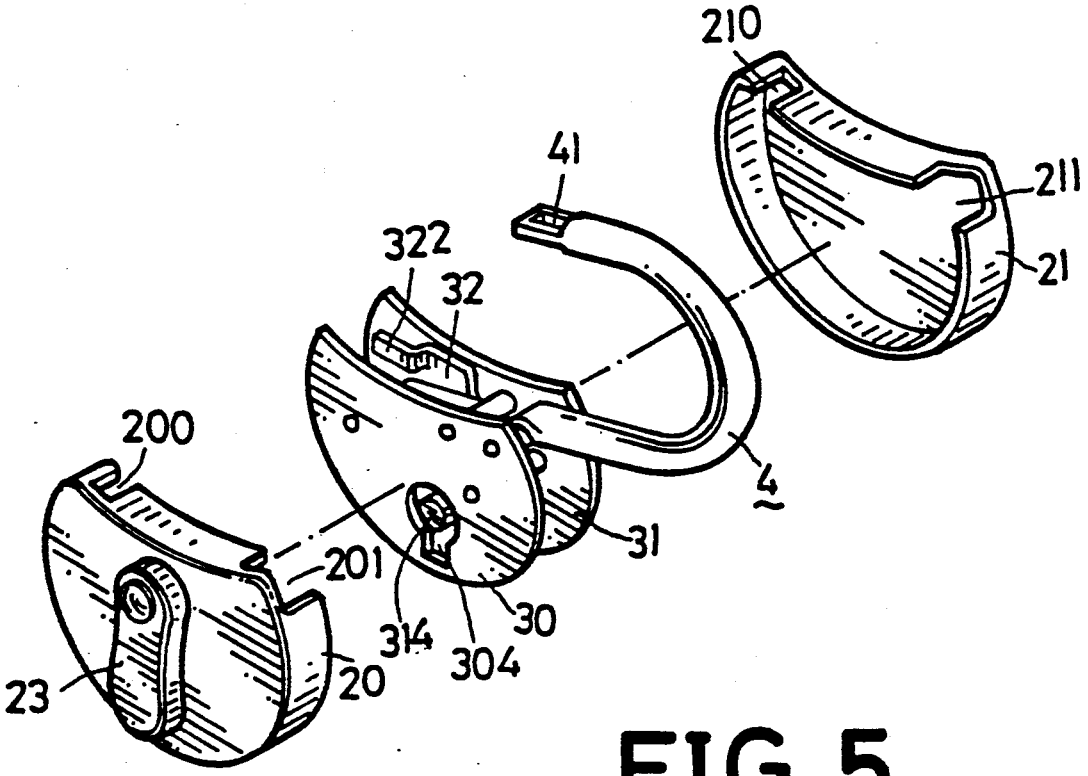
FIG. 5 is an exploded perspective view of the case of the locking mechanism of the present invention.
Figure 6:
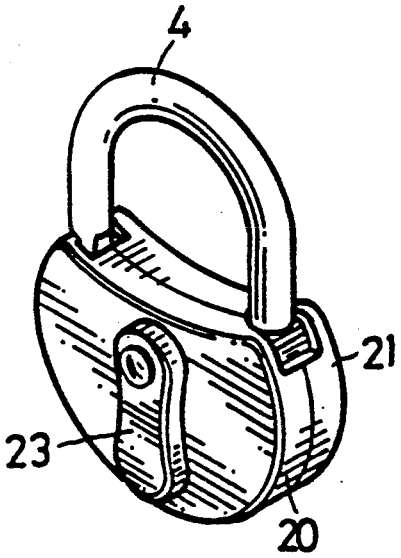
FIG. 6 is a perspective view of the padlock of the present invention.
Figure 9:
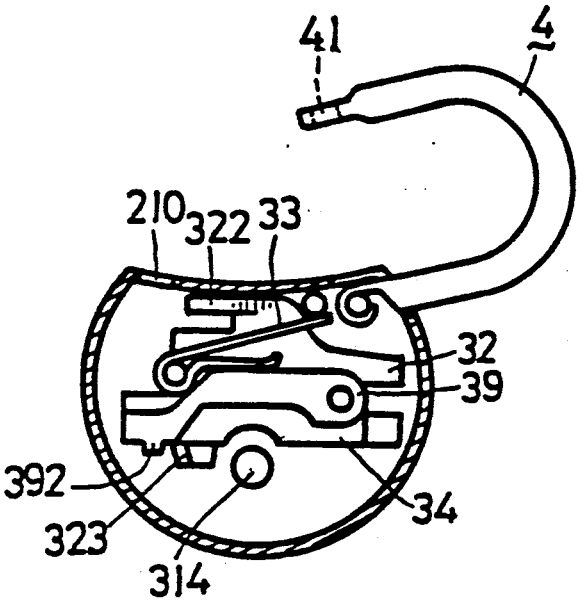
FIG. 9 is a cross-sectional view illustrating the relative unlocked positions of the shackle and the locking mechanism of the present invention.

In assembling this padlock, the locking plate 32 is first combined with the rear plate 30, by positioning the two openings 320, 321 over the guide pin 310 and the position pin 312, and then placing the plate spring 33 on the guide pin 310 with its upper end 330 in contact with the spring stop pin 311. Next, the plate tumbler 35, the shield chip 34 and the four tumblers 36, 37, 38, 39 are orderly combined with the rear plate by inserting the position pin 313 through the round holes 350, 340, 360, 370, 380, 390 and letting the upper edge of each of the plate tumblers and the shield chip contact the tip end 331 of the plate spring 33 and the upper left end 342 of the shield chip 34 contact the guide pin 310. At the same time, the projecting sidewise arm 323 of the locking plate 32 is positioned at the left side of the stop projections 352, 362, 372, 382, 392. The next step is to fit the round hole 40 in the shackle 4 over the pivot pin 312 as shown in FIG. 9. Then the front plate 30 is combined with the rear plate 31 by fitting into the four small holes 300, 301, 302, 303 the guide pin 310, the spring stop pin 311, the pivot pin 312, and the position pin 313, to finish assemblage of the lock mechanism and the shackle 4 as shown in FIG. 5. Then one end 220 of the spring 22 is positioned in the stopper 202 on the front case 20 and the other end 221 in the water-proof lid 23. Rivet 24 is riveted through the hole 230 in the lid 23 and the hole 202 in the front case 20 as shown in FIG. 5. The last process is to position the locking mechanism in the front case 20 and the rear case 21 and the shackle in the notches 201, 211 of both the half cases.

Figure 7:
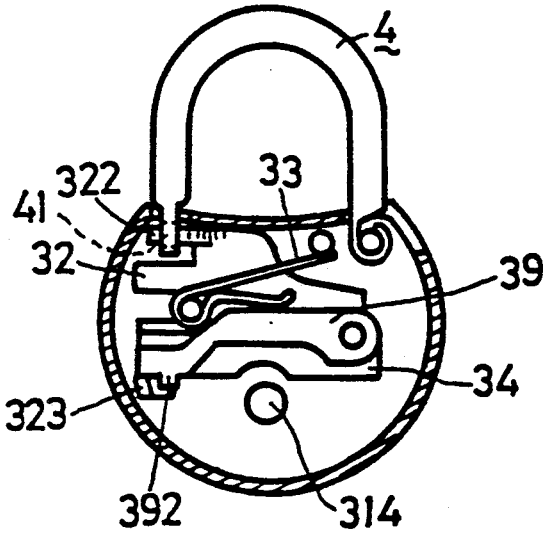
FIG. 7 is a cross-sectional view illustrating the relative locked positions of the shackle and the locking mechanism of the present invention.
Figure 8:
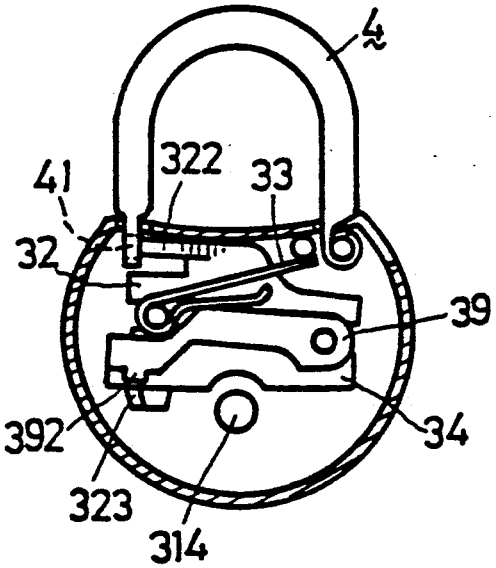
FIG. 8 is a cross-sectional view illustrating the relative positions of the shackle and the locking mechanism of the present invention as they move to their unlocked positions.
Figure 10:
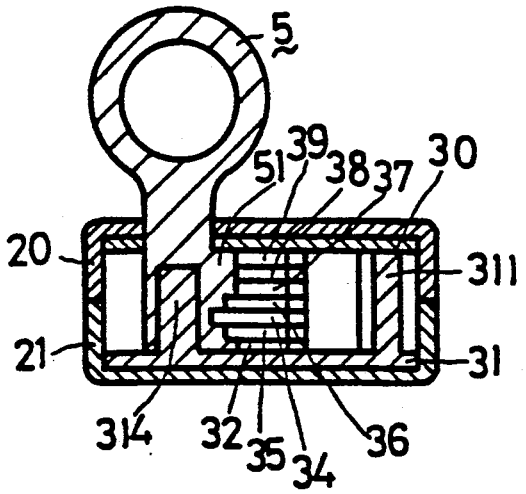
FIG. 10 is a cross-sectional view of the key inserted in the key holes of the present invention.
Figure 11:
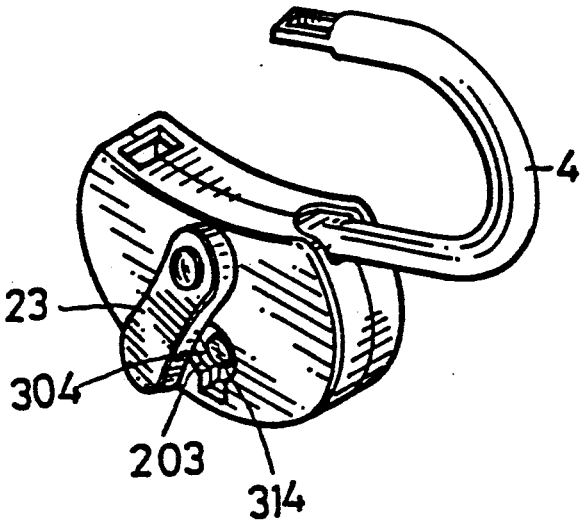
FIG. 11 is a perspective view of the water-proof lid moved aside on the front half case of the present invention.

In using this padlock, the water-proof lid 2 is moved aside to expose the key holes 203, 304 as shown in FIG. 11. Then, the key 5 is inserted through the key holes 203, 304 letting the cylindrical hole 50 fit over the key hole pin 314 so that the projection 51 is in contact with the recess 351 as shown in FIG. 10. Then the key 5 is turned to push the plate tumblers 35, 36, 37, 38, 39 upward by the key projection 51 such that the stop projections 351, 362, 372, 382, 392 are separated from the projecting sidewise arm 323. The key 5 is rotated further to make the lowest section of the key projection 51 fit in the notched arcuate shaped opening 324 and to move the locking plate 32 to the right or to the left letting the locking projection 322 move out of or into the locking hole 41 of the shackle 4, making the padlock unlocked or locked as shown in FIGS. 7, 8, 9.

Should the uneven outward edge of the key projection 51 of the key 5 not contact the recesses 351, 361, 371, 381, 391 of the plate tumblers, the recess 341 of the shield chip 34 and the notched, arcuate shaped opening 324 of the locking plate 32, the key 5 would not be able to be turned to push up all the five plate tumblers 35, 36, 37, 38, 39 hampered by the shield chip 34 to separate the stop projections 352, 362, 372, 382, 392 from the projecting sidewise arm 323 of the locking plate 32 such that the locking plate 32 may not be moved to the right to let the locking projection 322 move out of the locking hole 41 in the shackle 4. Thus, the padlock remains in the locked condition. If some tool is illegally used to try to pry up the plate tumblers, the shield chip 34 can prevent the tool from reaching the plate tumblers by the left upper end resting on the guide pin 310. Thus, the stop projection 352 still prevents movement of the projecting sidewise arm 323, preventing this padlock from being pried open.

This padlock is deemed to have the following advantages:

1. It cannot be unlocked except with a correct key, preventing it from burglary; and, 2. Locking security is better than conventional padlocks, as it locked by means of the locking projection 322 of the locking plate 32 being inserted through the locking hole 41 of the shackle 4.

I claim:

1. A padlock comprising:

a) a rear plate member having a guide pin, a pivot pin, a position pin and a key pin extending from an inner side;

b) a shackle having a generally U-shaped configuration pivotally mounted on the pivot pin and defining a locking hole;

c) a locking plate having a locking projection member adapted to engage the locking hole of the shackle and a projecting arm, the locking plate being slidably mounted on the guide pin and position pin so as to be movable between a locked position in which the locking projection member engages the opening in the shackle and an unlocked position in which the locking projection member is disengaged from the opening;

d) a plurality of plate tumblers each having a stop projection and defining a recess in a lower portion, the plate tumblers being pivotally mounted on the position pin so as to be movable between a first position wherein the stop projections contact the projecting arm of the locking plate so as to prevent its movement to the unlocked position and a second position wherein the stop projections are out of contact with the projecting arm by contact between a key and the recesses formed the lower portions;

e) a shield chip member mounted on the position pin and extending between an adjacent pair of plate tumblers;

f) a front plate member attached to the guide pin, the pivot pin and the position pin such that the locking plate, the plurality of plate tumblers and the shield chip member are located between the front and rear plate members, and defining a first key hole; and, g) a case formed separately from and enclosing the rear plate, the locking plate, the plate tumblers, the shield chip member and the front plate, the case defining a second key hole in alignment with the first key hole, and further defining notches to allow the shackle to pass through the case.

2. The padlock of claim 1 wherein the case comprises a front potion and a rear portion permanently attached together.

3. The padlock of claim 2 wherein the front and rear case portions are attached together by welding.

4. The padlock of claim 1 further comprising:

a) a cover member; and, b) attaching means to attach the cover member to the case such that it removably covers the second key hole.

5. The padlock of claim 4 wherein the attaching means comprises:

a) pivot means to pivotally attach the cover member to the case such that it is movable between a first position covering the second key hole and a second position displaced away from the second key hole; and, b) biasing means operatively interposed between the cover member and the case to bias the cover member toward its first position.

6. The padlock of claim 1 further comprising biasing means acting on the plate tumblers to bias them toward their first positions.

7. The padlock of claim 6 wherein the biasing means comprises a spring member.

* * * * *